United States Patent [19]

Knauer

[11] Patent Number: 5,005,475

[45] Date of Patent: Apr. 9, 1991

[54] ROTARY PRINTING MACHINE CONSTRUCTION

[75] Inventor: Peter Knauer, Rain/Lech, Fed. Rep. of Germany

[73] Assignee: Man Roland Druckmaschinen AG, Offenbach am Main, Fed. Rep. of Germany

[21] Appl. No.: 385,205

[22] Filed: Jul. 25, 1989

[30] Foreign Application Priority Data

Jul. 28, 1988 [DE] Fed. Rep. of Germany ..... 3825600

[51] Int. Cl.[5] ..... B41F 5/22; B41F 13/28

[52] U.S. Cl. ..... 101/218; 101/220; 101/182

[58] Field of Search ..... 101/375, 376, 216, 219, 101/220, 217, 218, 247, 177, 179, 180, 182, 136, 137–140, 142, 143–145, 248, 181

[56] References Cited

U.S. PATENT DOCUMENTS

| | | | |
|---|---|---|---|
| 4,119,032 | 10/1978 | Hollis | 101/375 |
| 4,398,464 | 8/1983 | Morbitzer et al. | 101/177 |
| 4,620,480 | 11/1986 | Hermach . | |
| 4,709,634 | 12/1987 | Momot et al. | 101/248 |
| 4,823,693 | 4/1989 | Kobler | 101/375 |

FOREIGN PATENT DOCUMENTS 3048840 3/1983 Fed. Rep. of Germany .

*Primary Examiner*—J. Reed Fisher

*Attorney, Agent, or Firm*—Frishauf, Holtz, Goodman & Woodward

[57] ABSTRACT

To permit re-sleeving or re-coating of circumferentially continuous printing cylinders, one of the side walls of the printing machine is formed with an opening which is closed off by two separable parts, which are movable towards and away from each other, the separable parts being formed with holes to receive stationary shafts for the respective cylinders. The stationary shafts have ball bearings thereon on which the cylinders are rotatably mounted, the shafts extending beyond bearings in a second side wall and being retained in bearings therein and, beyond the bearings, coupled to a counter holding arrangement so that, upon separation of the parts of the first side wall (1), the shafts come free, permitting access to the circumferences of the cylinders for re-coating or re-sleeving. The cylinders are coupled to drive gears therefor, which can be partly inclined to permit register adjustment and bearings or bearing bushings, eccentric with respect to the holding shafts, can be provided to permit engagement and disengagement of cylinders against each other.

7 Claims, 2 Drawing Sheets

ROTARY PRINTING MACHINE CONSTRUCTION

Reference to related patent, assigned to the assignee of the present application, the disclosure of which is hereby incorporated by reference: U.S. Pat. No. 4,807,527, Knauer.

The present invention relates to a rotary printing machine construction, and more particularly to such a construction which permits axial access to at least one of the cylinders, for example a blanket cylinder in an offset printing machine, to permit re-surfacing or re-sleeving of the cylinder. This is important in printing machines in which the respective cylinders do not have clamping grooves for clamping blankets thereon but, rather, a circumferentially continuous cylindrical cover.

BACKGROUND

U.S. Pat. No. 4,807,527, assigned to the assignee of the present application, Knauer, the inventor of the present application, describes a printing machine arrangement in which covers or sleeves on cylinders can be replaced. The cylinders, on which covers are to be replaced are fixed to a supporting and driving shaft. The shaft ends, projecting beyond the cylinder, are retained in special bearings. To replace the cover or sleeve on the cylinder, a holding apparatus must be located in line with the shaft end projecting from one of the side walls. The holding apparatus is located beyond the side wall. A portion of the side wall is then opened or removed, and thereafter the bearing for the shaft itself has to be disassembled. This is quite time-consuming. Problems arise if the shaft end is retained in one or more eccentric bushings or sleeves. Such eccentric retention is customary and permits engagement or disengagement of the respective cylinder against, or away from another cylinder of the printing machine. Lack of adjustability of the respective cylinder would simplify exchange of the cover sleeve; printing quality, however, may then decrease.

THE INVENTION

It is an object to improve a printing machine construction so that cylinders are readily accesible to permit exchange of sleeves while retaining a predetermined preset adjustment of the cylinder axis with respect to another cylinder, thereby retaining all register adjustments.

Briefly, the construction permits axial removal of a cover of at least one cylinder for resurfacing. The cylinders of the printing machine are constructed as hollow cylinders, that is, with a non-rotating shaft, by forming them as tubular elements which are retained by bearings on the non-rotating shaft. The cylinder shafts are slightly movable in circumferential, that is, slightly rotary or twisting direction, and/or in axial direction, to permit adjustment of the cylinder with respect to circumferential register, lateral register, or diagonal register, and driving or non-driving or stopping of the cylinder. All the operating and control structure for the cylinder are located adjacent one side wall of the printing machine, the other one of the side walls of the printing machine only including openings to receive the non-rotating cylinder shafts. The other side wall is constructed of a plurality of severable parts so that, upon separating the parts, access to the respective cylinders can be obtained for re-sleeving or re-surfacing a respective cylinder.

The system has the advantage that retaining the cylinders on through-shafts which do not rotate with the cylinder, but are merely slightly movable to change the register, the other side wall will not have any devices or components thereon which control any adjustment or require bearings. The multi-part severable side wall only has bearings to receive the ends of the shafts.

Re-sleeving or exchange of a cover on the cylinder is substantially simplified by this construction of the machine. It is only necessary to sever the other side wall, thereby freeing and releasing the ends of the shafts; after resleeving of a cylinder or all of the cylinders, the side wall parts are again moved towards each other, thus clamping the non-rotating shafts in position. None of the apparatus to control circumferential, lateral and diagonal register, to effect drive, engagement and disengagement of cylinders and the like, are interfered with nor touched during the re-sleeving operation and when the other side wall is separated. Thus, no re-adjustment of the cylinder drive arrangement is needed after re-sleeving of a cylinder.

Drawings

FIG. 1 is a highly schematic cross-sectional longitudinal view along line I—I of FIG. 2 and illustrating the holding operation for the cylinders; and FIG. 2 is an end and part-sectional view along line II—II of FIG. 1.

DETAILED DESCRIPTION

Figure 1:
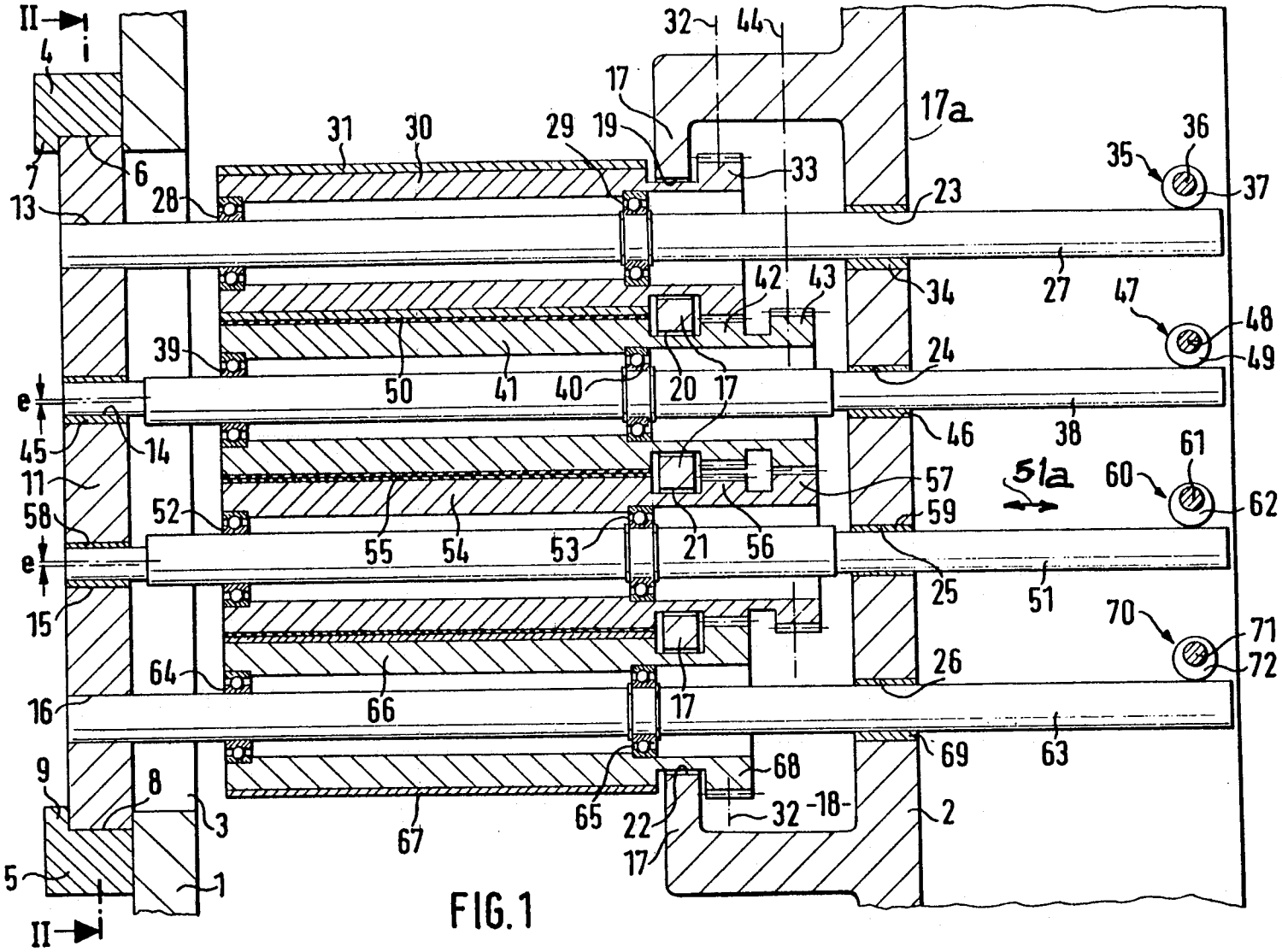

The rotary printing machine construction has a first side wall 1 and a second side wall 2. The first side wall 1 is formed with a wide opening 3 therein. Guide beams 4 and 5 are located above and below the opening 3 on the side wall 1. The upper guide beam 4 is formed with an undercut guide groove 6 which reaches up to the side wall 1 and which, towards the outside, forms an abutment or shoulder 7. Similarly, the lower guide beam 5 is formed with a guide groove 8 on its upper side, extending up to the side wall 1 and forming a shoulder or abutment 9 towards the outside.

Two plate-like shaft support panels 10, 11 (see FIG. 2) are retained in the guide grooves 6, 8 of the rails 4, 5. The plates 10, 11 are dimensioned to completely cover the opening 3, both in vertical as well as in horizontal direction. Within the range of the opening 3, they form, actually, the closing side of the side wall 1, and form part thereof. The plates 10, 11 can be moved towards and away from each other and are joined together, when assembled, at a separating line 12. Line 12 may form a slight gap. The line 12 is interrupted by a plurality of circular openings or bores 13, !4, 15, 16. The bores 13, 14, 15, 16 are vertically staggered and horizontally offset, and their position is such that they conform to the placement of the cylinders in the printing machine. The separating gap or line 12 passes, preferably, through the centers of the resPective circular bores 13–16. Communicating recesses **12*a*, 12*b*, 12*c* are formed. in the plates 10, 11 to permit placement of the separating gap or line 12 centrally through the respective bores, even where the bores are laterally offset. Side wall 1, due to the two plates 10, 11**, may be termed a composite wall.

The second side wall 2 (FIG. 2) is formed in doublewalled construction. The inner separating portion 17 of side wall 2, that is, the portion facing the side wall 1, together with the outer portion 17*a* thereof, forms a gear box 18. The separating wall 17 is formed with through-bores 19, 20, 21, 22, aligned with the bores 13–16 in side wall 1. Additional bores 23, 24, 25, 26 are located in side wall portion 17*a*, also aligned with the bores 19–22, respectively.

The upper row of bores, that is, bores 13, 19 and 23, receives a first or upper shaft 27. Shaft 27 is so long that it extends from bore 13 through the opening 19 and through the bore 23 and therebeyond. Shaft 27 has two bearings 28, 29 located thereon on which a hollow tubular cylinder 30 is rotatably retained. Cylinder carries at its outer circumference a replaceable sleeve 31 which, for example, carries the information which is to be printed. Cylinder 30 is coupled to or secured to a gear 33 located in a plane 32, parallel to the side wall 2. Gear 33 has axially parallel gears, with positive-profile shift. The left end of the shaft 26 is retained in the bore 13 formed by the respective half-openings in the plates 10 and 11. Cylinder 30 passes through the inner separating wall 17 in the region of the bore 19, leaving plenty of clearance between bore !9 and the cylinder 30. Shaft 27 is retained in the bore 23 by an eccenter bushing 34, i.e., a bushing which can rotate about an axis eccentric with respect to shaft 27, and which permits adjustment of the diagonal register of the cylinder 30 and the sleeve 31 thereover.. The projecting end of the shaft 27 is secured in position by a counter holding structure 35 which is formed by a shaft 36 and an eccentrically located cam holder 37 thereon. By rotating the shaft 36 and/or the cam holder 37, the cam can be engaged with the upper side of the shaft 27. It provides a holding force against the shaft 27 if, for example to exchange sleeve 31, the plates 10, 11 of the first side wall 1 are severed and moved laterally away from each other, thus leaving the end of the shaft 27, formerly in hole 3, free and unsupported.

Bores 14 and 24 retain a shaft 38, which also passes through the opening 20. Bearings 39, 40 support a hollow cylinder 41 on the shaft 38. The shaft 38 has a central thickened portion on which the bearings 39, 40 are located. This thickened portion is eccentric and shifted by the spacing e from the center of the shaft 38. Cylinder 41 carries a rubber jacket or sleeve 50 on its surface. The cylinder 41 is coupled to or has secured thereon two axially spaced gears 42, 43, located in the gear box 18. The first gear 42 is located in the plane 32, has axially extending gears with negative-profile shift. It meshes with the gear 33 on shaft 27. Gear 43 is axially to the right of gear 42, located in a second plane 44 parallel to plane 32 and the plane of side wall 2, respectively. The gear 43 is a spiral or inclined gear. The left end of the shaft 38 is retained in an eccentric bearing 45 which is used to set the base position of the shaft 38 upon assembly. Once assembled, the eccentric bearing 45 is tightened in position on the shaft 38 and remains thereon.

The opening 20 in the separating wall 17 of the second wall 2 is large enough so that cylinder 4! can easily pass therethrough, with sufficient play or clearance. Shaft 38 is retained in position by an eccenter bushing structure 46 which again is used to determine and set the base position of the shaft 38 upon initial assembly.

The end of shaft 38 which extends towards the right beyond the side wall 2 is retained by a counter holder 47 formed by a shaft 48 and an eccentric cam 49 secured to shaft 48. Upon rotation of shaft 48, cam 49 can be engaged against the upper side of shaft 38. The counter holder 47, together with the bearing in side wall 2, retains shaft 38 and hence cylinder 41 in horizontal position if, for example to exchange the rubber sleeve, or to place another sleeve on the cylinder 41, the plates !0 and 11 are separated by moving them laterally with respect to the fixed side wall 1.

Bores 15 and 25 retain a third shaft 51, which also passes through a wide opening 21 in the wall 17. Shaft 51 retains a hollow cylinder 54 thereon by bearings 52 and 53. Shaft 51 has an eccentric thickened portion on the middle part thereof, on which the bearings 52, 53 are located, the eccentricity having a dimension e with respect to the center of the shaft 51. The outer surface of the cylinder 54 carries a rubber sleeve 55. Cylinder 54 is coupled to or supports gears 56, 57 located in the gear box 18. The first gear 56 is in plane 32, and has axially parallel gear teeth, with negative-profile shift. It is out of engagement with respect to gear 42. The gear 57, coupled to gear 56, has inclined or spiral teeth and is engagement with the spirally toothed gear 43. The left end of the shaft 51 is surrounded by an eccentric bearing 58 which determines the base position of the shaft 51 upon assembly, and is then secured to the shaft end, to remain thereon, after having been adjusted. The opening or bore 21 in the wall 17 permits substantial clearance and play with respect to the cylinder 54.

Shaft 51 is retained in the side wall portion 17*a* of side wall 2 by an eccenter bushing 59 which, again, determines only the base position of shaft 51 upon initial assembly. The shaft 51 has a projecting portion, extending beyond the side wall 2, which is retained by a counter holder 60. Counter holder 60 is formed by a shaft 61 and an eccentric cam 62 thereon, secured to shaft 61. Upon rotation of shaft 61, cams 62 can engage the upper side of the shaft 51. The shaft 51, and cylinder 54 thereon, is held in horizontal position by cooperation of the bearing bushing in side wall 2 and the counter holder 60 if, to exchange the rubber sleeve 55 on cylinder 54, the plates 10, 11 are separated, thereby releasing the bushing 58 from the opening 15 in the side wall 1.

The lowest row of bores are the openings 16 in side wall 1 and 22, 26 in side wall 2. A fourth shaft 63 passes through these openings. The fourth shaft 63 extends beyond the second side wall 2. Shaft 63 has two bearings 64, 65 thereon on which a hollow cylinder 66 is retained which, at the outside thereof, carries a sleeve 67, for example retaining information to be printed on the verso side of a web 73, for example paper, or other material, and passed between cylinders 41 and 54, see FIG. 1.

Cylinder 66 has an axially toothed gear 68 secured thereto, located in the first 32 within the gear box 18. Gear 68 has a positive-profile shift. It meshes with the gear 56 on shaft 57. The left end of shaft 63 is secured in the bore 16 formed in the plates 10, 11. The cylinder 66 passes through the wall 17 in the region of the opening 22, with plenty of clearance. Side wall 2 retains the shaft 63 in an eccenter bushing 69, to permit diagonal register adjustment. The projecting end of the shaft 63 is retained by a counter element 70, formed by a shaft 71 and an eccentric cam 72 thereon. Upon rotation of shaft 71, cam 72 is engaged against the upper side of the shaft 63 and thus forms a counter holding force if, to exchange the sleeve 67 on the cylinder, first side wall 1 is separated by moving the plates 10, 11 away from each other..

Figure 2:
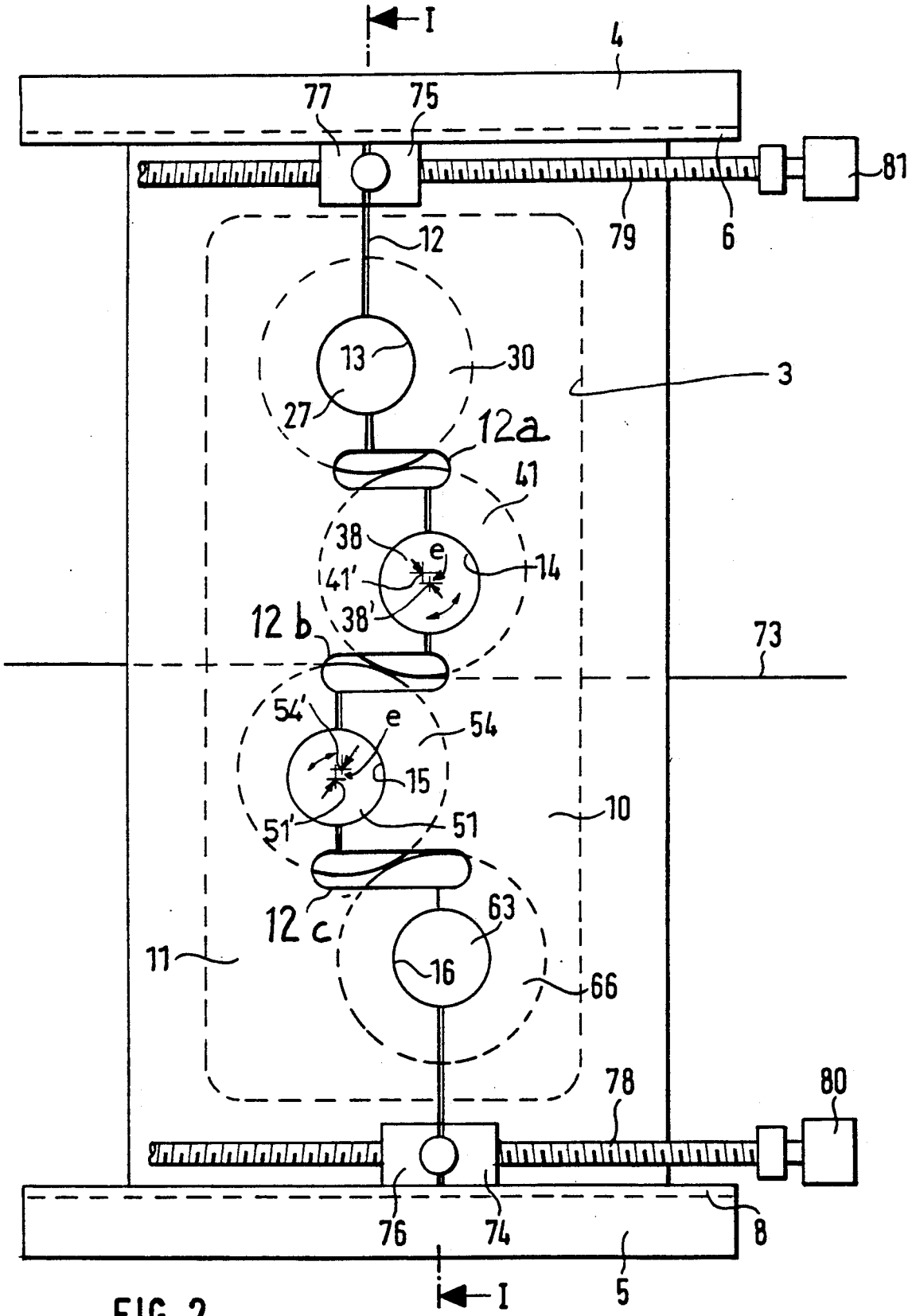

The web 73, see FIG. 2, is passed between cylinders 47, 54. Subject matter to be printed is offset from the sleeves 31, 67 of cylinders 30, 66 on the rubber sleeves 50, 55 of cylinders 41, 54, so that web 73 has printing applied thereto both on the prime and verso sides. Dampers and inkers, associated with the cylinders 30, 36, have been omitted from the drawing and,since they can be of any suitable commercial construction, are not illustrated.

Cylinders 41, 54 are driven from a drive gear with inclined gearing, in engagement with one of the gears 43, or 57. Such a main drive gear, which is standard, has been omitted from the drawing for clarity. Cylinder 30 then is driven by the axial gear pair 42, 33 and the lower cylinder 66 is driven via the axial gear pair 56, 68.

Shafts 27 and 63 of cylinders 30, 66, respectively, can be axially shifted for lateral register adjustment. By rotation of the eccenter bushings 34, 69, diagonal register can be adjusted. Shaft 38 of cylinder 41 is axially fixed. By rotating the shaft 38, the center of which is shown in FIG. 2 at 38', the cylinder 41 secured to the eccentric center portion of the shaft, is shifted about the center 38'. The center of the cylinder 41 is shown in FIG. 2 at 41'. Thus, cylinder 41 can be engaged or disengaged from the cylinder 54.

Likewise, cylinder 54 can be engaged with cylinder 41 by rotation of the shaft 51. The center of the shaft 51 is shown at 51' in FIG. 2, rotatable about the center 54' of the cylinder, and shiftable by the eccentricity e. In addition, shaft 51 of cylinder 54 is axially shiftable. Since, thereby, the inclined gears 57, 43 will roll off against each other, and gear 43 is axially secured to the shaft 38, mutual rotation will result which is transferred via the axially directed gears of the gear pairs 33, 42 and 56, 68 to result in relative circumferential register adjustment of the cylinders 30 and 66 with respect to each other. Axial shifting of the shaft 51 retaining the cylinder 54 is schematically indicated by the double arrow 51*a* in FIG. 1.

RE-SLEEVING AND EXCHANGE OF CYLINDER COVERS

To change the sleeves 31, 67, or the rubber jackets 50, 55, plates !0, 11 are separated horizontally, sliding in the respective guide grooves 6 and 8. In accordance with a preferred feature of the invention, the guide grooves separate the plates 10, !1 along a vertical separating line, that is, the plates are moved horizontally.

To move the plates 10, 11, the respective plates 10, 11 have spindle nuts 74, 75 and 76, 77 secured thereto, in engagement, respectively, with lower and upper spindles 78, 79. The spindle nuts 74, 75, 76, 77 have a threaded bore extending parallel to the guide grooves 6, 8, engaged by the respective threaded spindles 78, 79. The spindles can be rotated by drive motors 80, 81 coupled thereto; the motors are suitably retained on the side wall 1.

In accordance with a preferred feature of the invention, the upper and lower spindles have portions of different thread direction and, likewise, the spindle nuts have matching direction. For example, the spindle nut 74 coupled to plate 10 has a left-hand thread, the spindle nut 76 coupled to plate 11 a right-hand thread. Correspondingly, the spindle 78 has two portions of opposite pitch. From the positioning motor 80 up to the separating line 12, the thread is a left-hand thread; from the separating gap or line 12 to the end of the spindle 78, the thread is a right-hand thread. A similar arrangement is made at the upper sides of the respective plates 10, 11, in that the spindle 79 is formed with right-hand and left-hand threads, coupled, respectively, to right and left-handed spindle nuts 77, 75.

The plates 10, 11 are separated by rotating the positioning motors 80, 81, preferably in synchronism. The rotating, axially fixed spindle 78, 79 then move the plate 10 towards the right by engagement with the spindle nuts 74, 75 and move the plate 11 towards the left, upon engagement with the spindle nut 76, 77. The shafts 27, 38, 51, 63 are thus free from the plates 10, 11; they are retained in position by the counter holders 35, 47, 60, 70 and, together with their cylinders, are held in horizontal projection.

The plates 10, 11 are moved laterally away from each other until the opening 3 is freely accessible, permitting complete access to change one or more of the sleeves or jackets or covers of the respective cylinders. After interchange of sleeves or covers, spindles 78, 79 are rotated in opposite direction, causing the plates 10, 11 to move towards each other and surround the respective shafts 27, 38, 51, 63 with just enough clearance to permit slight rotary shift of the shafts for register adjustment.

Preferably, the threads on the spindles 78, 79, and of course of the matching spindle nuts are multi-pitch trapezoidal or Acme threads.

All elements standard in the printing machine field and not necessary for an understanding of the invention have been omitted. Thus, arrangements to provide for axial shift of any one of the shafts, for example of shaft 51, as well as for rotation of a shaft, have been left off. Adjustment elements of eccentric bushings, likewise, are not shown in the drawings since such adjustment elements are well known and any suitable structures may be used therefore. The particular shifting structures do not form part of the present invention.

Various changes and modifications may be made within the scope of the inventive concept.

I claim:

1. A rotary printing machine having a plurality of cylinders (30, 41, 54, 66) and constructed to permit axial access to at least one of said cylinders for resurfacing thereof, said machine further having
- a first side wall;
- a second side wall;
- the plurality of cylinders being secured for rotation between said side walls;

swherein said first side wall comprises a composite wall formed of a plurality of severable wall parts (10, 11) which are separable along at least one separating line (12) and movable relatively towards and away from each other, and holding means (35, 47, 60, 70) are provided for supporting the clyinders when the severable parts of the first side wall are separated, wherein all the cylinders of the plurality of cylinders (30, 41, 54, 66) are constructed as hollow cylinders;

a plurality of clyinder shafts (27, 38, 51, 63) are provided, retaining said hollow cylinders for rotation thereon;

means for retaining said cylinder shafts in said side walls while being slightly movable in at least one of: rotary position; axial position;

cylinder operating and control means are provided for, selectively, controlling operation of said cylinders with respect to at least one:
- cylinder register,
- lateral register, diagonal register, drive or stop of cylinders, said operating and control means for all said cylinders being located adjacent the second side wall (2); and wherein the first side wall includes openings (13, 14, 15, 16) receiving, only, the cylinder shafts (27, 38, 51, 63).

2. The printing machine of claim 1, wherein the plurality of cylinders (30, 41, 54, 66) comprise two blanket cylinders (41, 54);

printing blankets (50, 55) jacketing or surrounding the respective blanket cylinders;

said plurality of cylinders further comprising information carrying cylinders (30, 66), and jackets or sleeves (31, 67) surrounding the respective information carrying cylinders;

an axial gear (42, 56) with negative-profile shift secured to each blanket cylinder (41, 54), said gears being located in a first plane (32) extending essentially perpendicular to tne axes (38, 51) of said blanket cylinders;

a gear (33, 68) having axially extending gear teeth with positive-profile shift coupled to each one of said information carrying cylinders (30, 66) and located in said first plane, in meshing engagement with the gears on said blanket cylinders;

a spiral or inclined gear (43, 57) located in a second plane (44) parallel to said first plane (32) and coupled to each one of the blanket cylinders (41, 54), said spiral or inclined gears (43, 57) meshing with each other;

eccenter bushings (34, 69) retaining the cylinder shafts (27, 63) of the information carrying cylinders (30, 66) located in the second side wall (2) to permit diagonal register adjustment of said information carrying cylinders;

said blanket cylinders (41, 54) being located to be rotatable about an eccentrically positionable axis (38, 51) with respect to the center of the shafts (38, 51) t6 permit movement of said blanket cylinders between mutually engaged and disengaged positions upon rotation of the respective shaft (38, 51); and wherein at least one of the shafts (38, 51) supporting a respective blanket cylinder (41, 54) is axially movable for adjustment of circumferential register.

3. The printing machine of claim 1, wherein said first side wall comprises a side wall structure (1) having an opening (3) therein, and said wall parts include at least two plate-like elements (10, 11) separable at said separating line (12) and laterally shiftable with respect to each other, said parts being formed, when engaged against each other, with openings (13, 14, 15 16) for retaining the cylinder shafts (27, 38, 51, 63) when said plate elements are adjacent each other, and for release of said shaft upon lateral separation and shifting of said plate elements (10, 11), said openings intersecting the separating line (12).

4. The printing machine of claim 3, wherein two plate elements are provided, and the separating line (12) between said plate elements extends in essentially vertical direction and passes through the centers of said openings, said openings being essentially circular for receiving the cylinder shafts (27, 38, 51, 63).

5. The printing machine of claim 4, further including operating means to move said plate elements away from and towards each other, said operating means comprising a spindle (78, 79), motor means (80, 81) driving said spindle, and spindle bushings (74, 75; 76, 77) secured to said plate elements, said plate elements being laterally shiftable upon operation of said motor means.

6. The printing machine of claim 5, wherein said spindles (78, 79) and the spindle bushings (74, 75; 76, 77) are formed with threads which are, respectively, left-hand and right-hand threads associated with the respective plate elements whereby, upon rotation of said motor means in any given direction, the plates will, conjointly, move towards or away from each other.

7. The printing machine of claim 6, wherein said threads are multi-pitch trapezoidal or Acme threads.

* * * * *